US005654504A

United States Patent [19]

Smith et al.

[11] Patent Number: 5,654,504

[45] Date of Patent: Aug. 5, 1997

[54] DOWNHOLE PUMP MONITORING SYSTEM

[76] Inventors: Clark Allen Smith, deceased, late of Monahans, Tex.; by Rhoda Sue Smith, legal representative, P.O. Box 1683, Monahans, Tex. 79756

[21] Appl. No.: 542,620

[22] Filed: Oct. 13, 1995

[51] Int. Cl.[6] ..... F04B 49/00; E21B 47/06; F15C 1/16; G01L 7/06

[52] U.S. Cl. ..... 73/152.61; 73/152.52; 73/152.21; 166/66; 417/18; 417/22; 417/43; 417/448

[58] Field of Search ..... 73/152, 195, 152.61, 73/152.51, 152.52, 152.29, 152.22; 166/66; 417/63, 20, 22, 53, 18, 12, 42, 43, 448

[56] References Cited

U.S. PATENT DOCUMENTS

| | | | |
|---|---|---|---|
| 3,936,231 | 2/1976 | Douglas | 417/12 |
| 3,940,980 | 3/1976 | Tasker et al. | 73/152 |
| 4,076,457 | 2/1978 | Skinner et al. | 417/45 |
| 4,329,120 | 5/1982 | Walters | 417/12 |
| 4,480,960 | 11/1984 | Streib | 417/12 |
| 4,490,094 | 12/1984 | Gibbs | 417/42 |
| 4,741,208 | 5/1988 | Vandevier | 73/155 |
| 4,874,294 | 10/1989 | Karg | 417/12 |
| 4,887,628 | 12/1989 | Bowe | 137/8 |
| 4,913,625 | 4/1990 | Gerlowski | 417/18 |
| 5,049,046 | 9/1991 | Escue et al. | 417/411 |
| 5,190,442 | 3/1993 | Jorritsma | 417/7 |
| 5,222,867 | 6/1993 | Walker, Sr. et al. | 417/12 |
| 5,252,031 | 10/1993 | Gibbs | 417/53 |
| 5,458,466 | 10/1995 | Mills | 417/12 |

*Primary Examiner*—Hezron E. Williams
*Assistant Examiner*—J. David Wiggins
*Attorney, Agent, or Firm*—Mark A. Oathout

[57] ABSTRACT

The present invention relates to a downhole hydraulic pump monitoring system and more specifically relates to a system which detects and/or anticipates pump malfunctions by processing readings taken by a pressure transmitter on the operating pressure and the stroke rate of the downhole hydraulic pump where decisions are reached regarding positive pump operation or inefficient pump malfunction based upon comparisons between the instantaneous pressure readings of the pressure transmitter and a time-averaged operating pressure of the power fluid taken over a multitude of pump strokes.

4 Claims, 1 Drawing Sheet

DOWNHOLE PUMP MONITORING SYSTEM

BACKGROUND OF THE INVENTION

When the internal pressure in an oil well formation is not great enough to move oil to the surface of the well, a pump is required to move or produce the oil from the well. A downhole pump is one type of pump commonly used to produce the oil and derives its name from the fact that it is actually placed down within the oil well as opposed to a pump having the pumping rod located on the surface above the well. Certain conditions dictate the use of downhole pumps as opposed to surface pumps.

Problems occur when a downhole pump malfunctions or breaks down. Malfunctions or breakdowns result in decreased production, temporary halts in production, inaccuracies in oil volume measurements, maintenance expenses, and expenses required to oversee, repair and check such pumps.

SUMMARY OF THE INVENTION

The present invention relates to a downhole hydraulic pump monitoring system and more specifically relates to a system which detects and/or anticipates pump malfunctions by processing readings taken by a pressure transmitter on the operating pressure and the stroke rate of the downhole hydraulic pump.

DETAILED DESCRIPTION OF THE INVENTION

Figure 1:
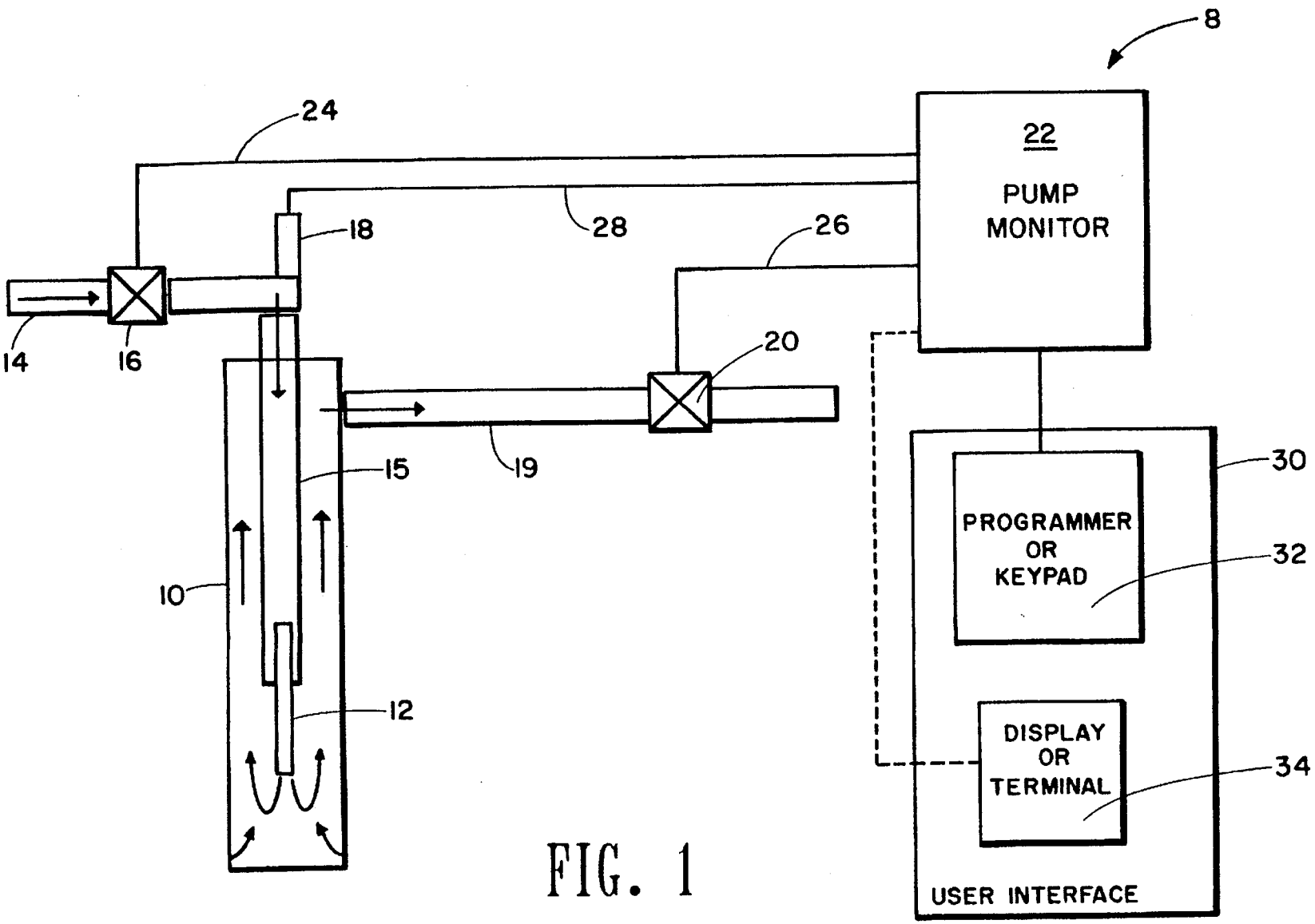
FIG. 1 is a schematic view of the system incorporating the invention.

Referring to FIG. 1, the downhole hydraulic pump monitoring system 8 is shown. The system 8 is used in an oil well 10 which is producing oil. A downhole hydraulic pump 12 is placed down within the oil well 10. An inflowing supply line 14 conveys a power fluid, typically oil, to a supply line 15 which runs into the well 10 to power the hydraulic pump 12. Oil or fluid produced from the well is typically pumped up the sides of the well 10 along with the power fluid supplied to power the hydraulic pump 12. This oil flows through an outflowing line 19.

A power fluid flow meter 16 is mounted in the inflowing line 14. Flow meter 16 detects the amount of power fluid flowing through lines 14 and 15 to power hydraulic pump 12. A pressure transmitter 18 is mounted either on the inflowing supply line 14 or the downhole supply line 15 at a position where pressure fluctuations can be accurately detected (preferably as close to the pump 12 as is practical). The pressure transmitter 18 is preferably a 4–20 Ma pressure transmitter. A production flow meter 20 is typically mounted in the outflowing line 19. Flow meter 20 measures the amount of outflowing power fluid combined with the fluid produced from the well 10.

A pump monitor 22 including a data processor can be used to monitor the inflowing flow meter 16, the production flow meter 20, and the pressure transmitter 18 via transmitter lines 24, 26, and 28 respectively. A user interface 30 is connected to the pump monitor 22. The user interface 30 may comprise a hand held programmer or keypad 32 and a display or terminal 34. The user interface could also comprise a computer. The user interface 30 allows data retrieval and programming.

The pump monitoring system 8 uses a combination of hardware and software to perform several functions: the pressure of the power fluid in inflowing line 14 is measured and converted to PSI and a supply operating pressure reading is recorded; the stroke rate of the downhole pump 12 is detected and calculated; malfunctions of the downhole hydraulic pump are determined or anticipated; the flow rate of power fluid through inflowing line 14 is determined; the flow rate of power fluid through outflowing line 19 is determined; to enable the input of higher and lower limits or setpoints into the system 8; to output several types of data from the system 8; and to automate control of the system 8.

The hydraulic pump 12 accepts varying volumes of power fluid when the pump 12 is operating, reciprocating or stroking. Variations cause pressure fluctuations to be reflected up the downhole line 15. Therefore each stroke of the hydraulic pump 12 will create a pressure fluctuation. The pressure transmitter 18 detects an instantaneous power fluid supply pressure which will vary due in part to these pressure fluctuations. The pressure of the supply power fluid at the wellhead or surface is typically between 1,000 and 3,000 PSI and the pressure fluctuations detected by the pressure transmitter 18 typically range between 50 and 200 PSI.

In order to calculate the stroke rate of the hydraulic pump 12 the instantaneous supply pressure is first detected by pressure transmitter 18. The pump monitor 22 then calculates an average or operating supply pressure by taking the average of a series of instantaneous pressure readings (e.g. separate instantaneous pressure readings of 1275, 1290, 1290, 1275 would result in an operating pressure of 1282.5). When the instantaneous pressure rises above the average pressure, a stroke is detected and recorded. The total number of strokes are counted and used to calculate the strokes per minute or the time between successive strokes.

The pump monitor 22 is the device which calculates the number of pressure fluctuations per minute in order to measure the rate at which the pump is stroking. This data can be outputed at user interface 30. The pressure fluctuation readings or calculations are used to determine and/or anticipate downhole hydraulic pump malfunctions. The user interface 30 can also include a relay for turning the oil supply on or off. A suitable control system including pump monitor 22 and user interface 30 is available from Ryo-Tech of Monahans, Tex.

The power fluid flow meter 16 is used to count and record the volume (BBLS) of fluid flowing in. The production flow meter 20 is used to count and record the volume of fluid flowing out. The volume of fluid flowing out is compared to the volume of fluid flowing in in order to determine and record the volume of fluid produced.

User interface 30 can be used to input high and low limits or set points for pressure, stroke rate, flow rate through inflowing line 14, and flow rate through outflow line 19. If a high or a low limit is violated a set number of times (as set through the user interface 30) a predetermined action can be triggered. The pump monitor 22 may be programmed to take the following actions: no action, step and restart after downtime, stop and wait for a manual reset, and/or to trigger an alarm. A malfunction of the downhole pump 12 can be anticipated or detected by deviations beyond the high and low limits set for stroke rate and operating pressure. Each well has its own characteristics and therefore, the user should program the upper and lower limits based upon the individual characteristics of each will. Nevertheless, the violation of a lower limit suggests a rupture or break between the supply line and the pressure transmitter and the pump, that the supply pressure has failed or there is a transducer failure; the violation of an upper limit suggests that the pump is stuck or there is a broken transducer; and the violation of the stroking rate limit implies a malfunction in the pumping system except for any effects due to the possible occurence of well-producing fluid or formation fluid induced-flow variations.

Data can be outputed from the user interface 30 at user selected intervals. When the selected intervals occur data may be outputed on status, time, operating pressure, stroke rate, flow rate through inflowing line 14 and flow rate through outflowing line 19. The keypad 32 allows the user to change various parameters used by the system 8. The system can also be started and stopped from the keypad 32. The display 34 will preferably display various parameters entered via keypad 32 and any output data.

For communications the System can be equipped with a connector such a 9 pin RS 232 style connector to access the system from a portable computer or by radio from a central computer (not shown). The invention can be used to monitor several wells at the same time and to store data for retrieval at a later time.

A flow chart for the downhole hydraulic pump monitoring system 8 follows:

FLOW CHART

```
POWER ON
CLEAR MEMORY AND SET UP PROCESSOR
BEGIN MAIN LOOP
SEND OR RECEIVE DATA VIA THE SERIAL I/O
        HAS 10 MILLISECONDS PASSED
        NO          YES
                    SET FLAG B10MSA
                    INCREMENT THE TIMER
                    USED FOR MEASURING
                    STROKES/MIN.
                    READ A/D CONVERTER
                    CHECK FOR KEYS PRESSED
                    CHECK DISPLAY
                    IF 1 S HAS PASSED
                    INCREMENT THE RUNTIME
                    CHECK THE TIME
                    OF DAY CLOCK
IF B10MSA IS SET GO TO THE NEXT TASK
TASK RETURN
CLEAR B10MSA
RETURN TO MAIN LOOP
TASK 1

CHECK THE KEYPAD 32 AND UPDATE
THE DISPLAY 34 IF REQUIRED
GO TO TASK RETURN
TASK 2

FILTER THE PRESSURE INPUT SIGNAL
IF A MESSAGE HAS BEEN RECEIVED VIA
THE SERIAL PORT QUEUE THE ANSWER
GO TO TASK RETURN
TASK 3

CALCULATE
THE PRESSURE IN PSI
CHECK FOR HIGHEST OR
LOWEST RECORDED PRESSURE
IF TRIGGER IS SET AND
THE PRESSURE HAS NOT BEEN
GOING DOWN FOR 0.5 SEC
COUNT A STROKE AND CLEAR
TRIGGER - IF THE PRESSURE
HAS NOT BEEN GOING
DOWN FOR THE SELECTED TIME SET TRIGGER
GO TO TASK RETURN
```

-continued

FLOW CHART

```
TASK 4

READ THE FLOW METER INPUTS
UPDATE THE FLOW VOLUMES
GO TO TASK RETURN
TASK 5

CALCULATE FLOW RATE
GO TO TASK RETURN
TASK 6

UPDATE THE FLOW RATE READINGS
GO TO TASK RETURN
TASK 7

IF IT IS TIME
TO STORE DATA DO IT
GO TO
TASK RETURN
TASK 8

IF ANY OF THE INPUTS
ARE ABOVE OR BELOW THEIR
SET POINTS TAKE
THE SPECIFIED ACTION
GO TO TASK RETURN
TASK 9

CALCULATE THE AVERAGE
STROKES/MINUTE FOR
THE LAST 10 STROKES AND UPDATE
THE STROKES/MINUTE REGISTER
GO TO TASK RETURN
TASK 10

IF IT IS TIME FOR THE DAILY REPORT DO IT
GO TO TASK RETURN
```

Table 1 below is a sample display or output from the pump monitoring system used in connection with a single well having a downhole hydraulic pump.

TABLE 1

| TIME | STROKES/PER MINUTE | INSTANTANEOUS PRESSURE (PSI) | VOLUME (BBLS) |
|---|---|---|---|
| 11:42 | 0 | 1290 | 0 |
| 11:57 | 35.5 | 1290 | 5 |
| 12:12 | 24.5 | 1290 | 10.1 |
| 12:27 | 29.5 | 1290 | 15.2 |
| 12:42 | 33 | 1275 | 20.2 |
| 12:57 | 39 | 1290 | 25.2 |
| 13:12 | 30.5 | 1290 | 30.3 |
| 13:27 | 29 | 1275 | 35.3 |
| 13:42 | 29 | 1275 | 40.4 |
| 13:57 | 38 | 1275 | 45.4 |
| 14:12 | 31 | 1290 | 50.5 |
| 14:27 | 25 | 1275 | 55.5 |
| 14:42 | 35 | 1275 | 60.6 |
| 14:57 | 27 | 1290 | 65.6 |
| 15:57 | 30.5 | 1275 | 85.8 |
| 16:12 | 26 | 1290 | 90.9 |
| 16:27 | 37.5 | 1275 | 95.9 |
| 16:42 | 38.5 | 1260 | 101 |
| 16:57 | 37 | 1275 | 106 |
| 17:12 | 24.5 | 1260 | 111 |
| 17:27 | 29 | 1260 | 116 |
| 17:42 | 32.5 | 1260 | 121.1 |
| 17:57 | 36.5 | 1275 | 126.1 |
| 18:12 | 21.5 | 1260 | 131.1 |
| 18:21 | 31 | 1245 | 136.1 |
| 18:42 | 32.5 | 1245 | 141.1 |
| 18:57 | 25.5 | 1245 | 146.2 |
| 19:12 | 40.5 | 1245 | 151.2 |

TABLE 1-continued

| TIME | STROKES/PER MINUTE | INSTANTANEOUS PRESSURE (PSI) | VOLUME (BBLS) |
|---|---|---|---|
| 19:27 | 40.5 | 1245 | 156.2 |
| 19:42 | 36.5 | 1245 | 161.2 |
| 19:57 | 37.5 | 12.45 | 166.2 |
| 20:12 | 35.5 | 1245 | 171.2 |
| 20:27 | 24 | 1245 | 176.2 |
| 20:42 | 24 | 1230 | 181.2 |
| 20:57 | 24 | 1245 | 186.2 |
| 21:12 | 30.5 | 1245 | 191.2 |
| 21:27 | 26 | 1245 | 196.2 |
| 21:42 | 27.5 | 1245 | 201.3 |
| 21:57 | 30.5 | 1245 | 206.3 |
| 22:12 | 35.5 | 1245 | 211.3 |
| 22:27 | 30.5 | 1245 | 216.3 |
| 22:42 | 31 | 1260 | 221.3 |
| 22:57 | 35.5 | 1260 | 226.3 |
| 23.12 | 33 | 1260 | 231.3 |

What is claimed is:

1. In a well having a power fluid supply line connected to a downhole hydraulic pump characterized by having a variable stroke rate for moving a power fluid, and an outflowing line from the well, a monitoring system for detecting and anticipating a pump malfunction or breakdown comprising:

a pressure transmitter mounted on the power fluid supply line to give real-time readings of instantaneous pressure and pressure fluctuations therein;

a pump monitor connected to said pressure transmitter, said pump monitor including a time averaging means for calculating an operating pressure of a power fluid in said supply line as based upon the readings of said pressure transmitter, an analytical means for calculating a stroke rate for the downhole hydraulic pump, and a decision making means for processing the operating pressure and the stroke rate to detect a malfunction of the downhole hydraulic pump; and a means for inputting upper and lower limits for both of the operating pressure and the stroke rate connected to said decision making means for processing the operating pressure and the stroke rate including a comparison and alarm means which responds to situations where said calculated operating pressure and/or said stroke rate do not have values within the range of each respective upper and lower limits.

2. The monitoring system according to claim 1 further comprising a status means for displaying information generated from the monitoring system as connected to said pump monitor.

3. The monitoring system according to claim 1 further including a first flow meter mounted in the power fluid supply line and in communication with said pump monitor and a second flow meter mounted in the outflowing line and in communication with said pump monitor.

4. In a well having a power fluid supply line connected to a downhole hydraulic pump characterized by having a variable stroke rate for moving a power fluid, and an outflowing line from the well, a method for monitoring the downhole hydraulic pump so as to detect and anticipate a pump malfunction or breakdown comprising the following steps:

mounting a pressure transmitter on the power fluid supply line at a location where pressure and pressure fluctuations in a power fluid generated by the downhole hydraulic pump can be detected as a function of time;

inputting an upper and a lower limit for a stroke rate of the pump and inputting a different upper and a lower limit for an operating pressure of the power fluid into a pump monitor which is in communication with the pressure transmitter;

detecting an instantaneous pressure of the power fluid via the pressure transmitter;

calculating an operating pressure based upon an average of the instantaneous pressure taken over a multitude of successive pump pulses via the pump monitor;

comparing the operating pressure to the instantaneous pressure whereby a stroke of the downhole hydraulic pump can be determined via the pump monitor; calculating the stroke rate via the pump monitor;

comparing the stroke rate and the operating pressure to the upper and the lower limit; and according to whether the upper and the lower limit has been violated for either or both of the stroke rate and the operating pressure, taking a predetermined action from among a group of possible actions comprising:

taking no action;

stopping and restarting after a downtime;

stopping and waiting for a manual reset;

or triggering an alarm.

* * * * *